US011866279B2

(12) United States Patent
Yun et al.

(10) Patent No.: US 11,866,279 B2
(45) Date of Patent: Jan. 9, 2024

(54) FILM WRINKLE REMOVING ROLLER

(71) Applicant: LG CHEM, LTD., Seoul (KR)

(72) Inventors: Sung Hyun Yun, Daejeon (KR); Ji Hun Kim, Daejeon (KR); Joo Yong Park, Daejeon (KR); Jae Choon Yang, Daejeon (KR)

(73) Assignee: LG CHEM, LTD., Seoul (KR)

( * ) Notice: Subject to any disclaimer, the term of this patent is extended or adjusted under 35 U.S.C. 154(b) by 708 days.

(21) Appl. No.: 17/055,675

(22) PCT Filed: May 2, 2019

(86) PCT No.: PCT/KR2019/005289
§ 371 (c)(1),
(2) Date: Nov. 16, 2020

(87) PCT Pub. No.: WO2019/221427
PCT Pub. Date: Nov. 21, 2019

(65) Prior Publication Data

US 2021/0198071 A1 Jul. 1, 2021

(30) Foreign Application Priority Data

May 17, 2018 (KR) ..... 10-2018-0056454

(51) Int. Cl.
*B65H 23/025* (2006.01)
*B65H 20/02* (2006.01)

(52) U.S. Cl.
CPC ..... *B65H 23/025* (2013.01); *B65H 20/02* (2013.01); *B65H 2404/10* (2013.01); *B65H 2701/1752* (2013.01)

(58) Field of Classification Search
CPC ..... B65H 23/025; B65H 23/0251
USPC ..... 492/40
See application file for complete search history.

(56) References Cited

U.S. PATENT DOCUMENTS

| | | | | |
|---|---|---|---|---|
| 4,566,162 | A * | 1/1986 | Brands | B65H 23/0251 242/525.7 |
| 7,113,725 | B2 | 9/2006 | Ogashiwa et al. | |
| 2010/0054826 | A1 | 3/2010 | Hieda | |
| 2018/0250862 | A1 | 9/2018 | Takata et al. | |

FOREIGN PATENT DOCUMENTS

| | | | |
|---|---|---|---|
| CN | 1874945 | A | 12/2006 |
| EP | 2 629 154 | A2 | 8/2013 |
| JP | S57-111559 | | 12/1980 |
| JP | 5-341684 | A | 12/1993 |

(Continued)

OTHER PUBLICATIONS

International Search Report for PCT/KR2019/005289 dated Aug. 12, 2019.

*Primary Examiner* — Jason L Vaughan
(74) *Attorney, Agent, or Firm* — Birch, Stewart, Kolasch & Birch, LLP

(57) ABSTRACT

The present invention relates to a film wrinkle removing roller in which pattern rolls coated with rubber are positioned at both ends of a cylindrical roll made of Teflon, and a porous film comes into contact with the roll and the pattern rolls, such that the film may be prevented from wrinkling and a surface of the film may be prevented from being abraded due to friction between the film and surfaces of the rolls.

6 Claims, 4 Drawing Sheets

(56) References Cited

FOREIGN PATENT DOCUMENTS

| | | | |
|---|---|---|---|
| JP | 6-1510 | A | 1/1994 |
| JP | 8-133544 | A | 5/1996 |
| JP | 2000-86031 | A | 3/2000 |
| JP | 2001-317538 | A | 11/2001 |
| JP | 2003-345091 | A | 12/2003 |
| JP | 2011-178490 | A | 9/2011 |
| JP | 2012-62553 | A | 3/2012 |
| JP | 5434859 | B2 | 3/2014 |
| JP | 5649853 | B2 | 1/2015 |
| JP | 6070455 | B2 | 2/2017 |
| KR | 10-2006-0093333 | A | 8/2006 |
| KR | 10-2010-0081396 | A | 7/2010 |
| KR | 10-2018-0024150 | A | 3/2018 |
| WO | WO 98/33734 | A1 | 6/1998 |

* cited by examiner

[Figure 1]
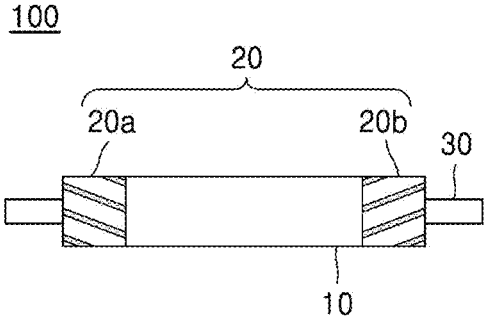
(a)
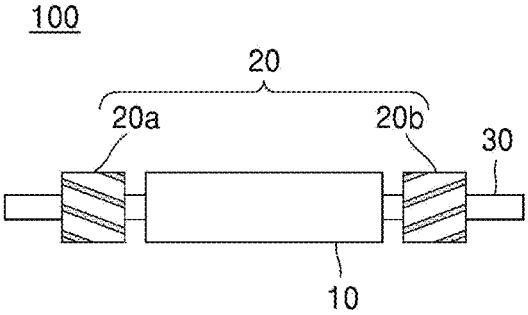
(b)

[Figure 2]
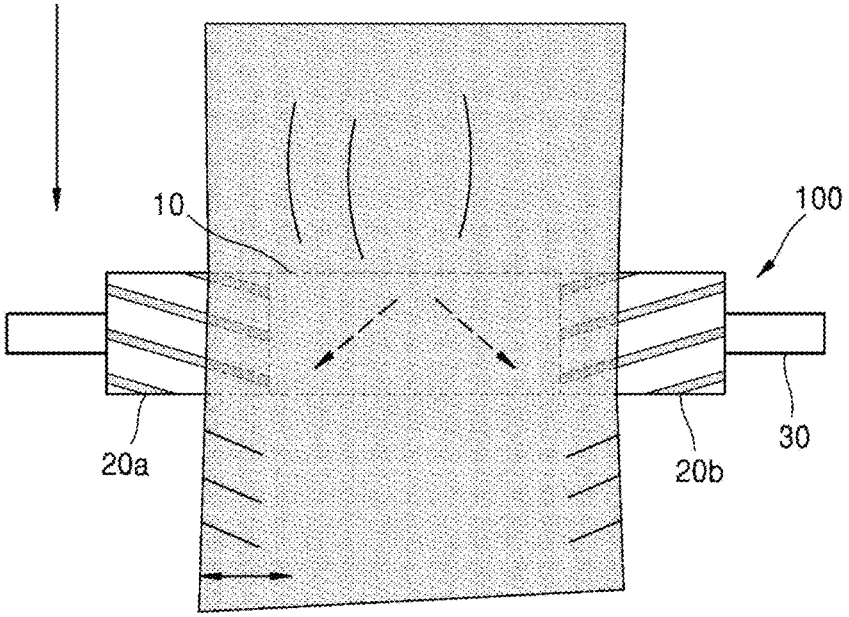

[Figure 3]
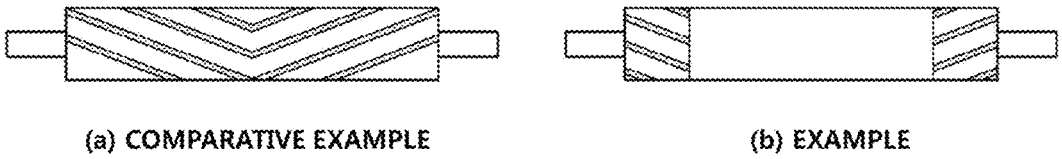

[Figure 4]

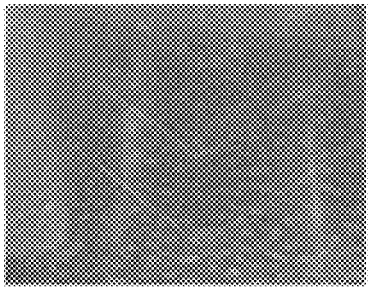

<SURFACE OF FILM IN CONTACT WITH FILM WRINKLE IMPROVING ROLLER OF COMPARATIVE EXAMPLE>

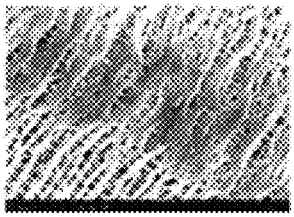

<SEM PHOTOGRAPH OF PORES IN SURFACE OF FILM IN CONTACT WITH FILM WRINKLE IMPROVING ROLLER OF COMPARATIVE EXAMPLE>

(a) COMPARATIVE EXAMPLE

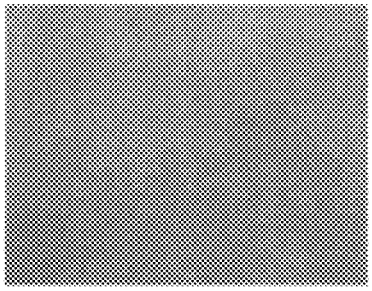

<SURFACE OF FILM IN CONTACT WITH FILM WRINKLE REMOVING ROLLER OF EXAMPLE>

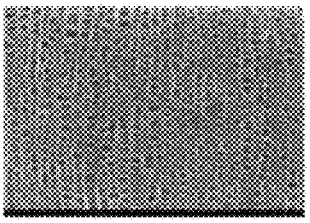

<SEM PHOTOGRAPH OF PORES IN SURFACE OF FILM IN CONTACT WITH FILM WRINKLE REMOVING ROLLER OF EXAMPLE>

(b) EXAMPLE

FILM WRINKLE REMOVING ROLLER

TECHNICAL FIELD

The present invention relates to a film wrinkle removing roller, and more particularly, to a film wrinkle removing roller in which pattern rolls coated with rubber are positioned at both ends of a cylindrical roll made of Teflon, and a porous film comes into contact with the roll and the pattern rolls, such that the film may be prevented from wrinkling and a surface of the film may be prevented from being abraded due to friction between the film and surfaces of the rolls.

BACKGROUND ART

A porous film is applied as a porous reinforcement base used for a separation membrane for a rechargeable battery and a reinforcement membrane for a fuel cell. Examples of the porous film used in this application field include polyethylene (PE), polypropylene (PP), polytetrafluoroethylene (PTFE), and polyethylene terephthalate (PET) films.

Here, multiple rolls may be used to convey the film during the process of producing the porous film, and these rolls may be made of various materials in accordance with the intended use or characteristics.

In general, the porous film may be produced through a roll-to-roll film moving process. In this case, the porous film may wrinkle because tension is applied in a movement direction of the film while the thin porous film moves.

Therefore, a process of removing a wrinkle of the film is considered as an important factor among the processes of producing the film, and as a result, an industrial roll capable of improving a wrinkle of the film is being developed.

In the case of a film wrinkle improving roller in the related art, a cylindrical roll having a predetermined pattern is provided, and a raw film passes over the cylindrical roll, such that a wrinkle formed on the film is improved.

However, in the case of the film wrinkle improving roller in the related art, a pattern roll is made of rubber and metal, and the thin film passes the pattern roll, and as a result, there is a problem in that frictional force between the surface of the film and the rubber pattern roll is increased, which causes damage to the film.

In addition, because the film wrinkle improving rubber roller in the related art has the single pattern roll made of rubber, there is a problem in that an afterimage of a pattern is formed on the surface of the film while the film passes the pattern roll. For this reason, there is a problem in that the surface of the film is not uniformly coated during the film coating.

In addition, in the case of the film wrinkle improving roller in the related art, because the entire surface of the cylindrical roll is made of only rubber, there is a problem in that a film movement property deteriorates due to frictional force between the film and the roll. For this reason, there is a problem in that productivity of the film deteriorates.

DETAILED DESCRIPTION OF THE INVENTION

Technical Problem

An object of the present invention is to provide a film wrinkle removing roller in which a pair of pattern rolls coated with rubber is provided at both ends of a cylindrical roll made of Teflon, and a thin porous film comes into contact with the roll and the pattern rolls, such that an abrasion, which causes an afterimage of a pattern to be formed on a surface of the film by a pattern shape, may be prevented and the surface of the film may be uniformly coated during film coating.

In addition, an object according to an exemplary embodiment of the present invention is to provide a film wrinkle removing roller in which a cylindrical roll, which comes into contact with an effective width of a raw film, is made of Teflon having low frictional force, such that the film passing the roll is unwrinkled in a width direction by pattern rolls, made of rubber, at both ends of the roll while the film passes between the roll and the pattern rolls, and the film may smoothly move without wrinkles, and as a result, productivity of the film may be improved.

Technical Solution

The present invention provides a film wrinkle removing roller including: a roll having a cylindrical shape; a pair of pattern rolls positioned at both ends of the roll and having patterns; and a roll fixing unit configured to fix positions of the roll and the pattern rolls, in which the pair of pattern rolls are separable from the roll and the pair of pattern rolls are made of a different material having a different frictional force than a material and a frictional force of the roll.

In the exemplary embodiment, the roll may be made of metal and an entire surface of the roll may be coated with Teflon having a predetermined thickness.

In the exemplary embodiment, the roll may be made of Teflon.

In the exemplary embodiment, each pattern roll may be made of metal and an entire surface of each pattern roll may be coated with rubber having a predetermined thickness.

In the exemplary embodiment, the pair of pattern rolls may include a first pattern roll disposed at a first end of the roll and a second pattern roll disposed at a second end of the roll, the first end of the roll being opposite to the second end of the roll.

In the exemplary embodiment, the pattern of the first pattern roll is symmetrical to the pattern of the second pattern roll.

Advantageous Effects

According to one aspect of the present invention, the pair of pattern rolls coated with rubber is provided at both ends of the cylindrical roll made of Teflon, and the thin porous film comes into contact with the roll and the pattern rolls, such that an abrasion, which causes an afterimage of a pattern to be formed on the surface of the film, may be prevented and the surface of the film may be uniformly coated during the film coating.

In addition, the cylindrical roll is made of Teflon having low frictional force, such that the film passing the roll is unwrinkled in the width direction by the pattern rolls, made of rubber, at both ends of the roll while the film passes between the roll and the pattern rolls, and the film may smoothly move without wrinkles, and as a result, productivity of the film may be improved.

BRIEF DESCRIPTION OF DRAWINGS

FIG. 1 is a view schematically illustrating a structure of a film wrinkle removing roller 100 according to an exemplary embodiment of the present invention.

FIG. 2 is a view schematically illustrating a state in which a film comes into contact with the film wrinkle removing roller 100 according to the exemplary embodiment of the present invention.

(a) of FIG. 3 is a view schematically illustrating a shape of the film wrinkle removing roller according to a Comparative Example and (b) of FIG. 3 is a view schematically illustrating a shape of a film wrinkle improving roller according to the present invention.

FIG. 4 is a view illustrating a comparison between the film that has passed the film wrinkle removing roller according to the Example of the present invention and the film that has passed the film wrinkle improving roller according to the Comparative Example.

EXPLANATION OF REFERENCE NUMERALS AND SYMBOLS

100: Film wrinkle removing roller
10: Roll
20: Pattern roll
20*a*: First pattern roll
20*b*: Second pattern roll
30: Roll fixing unit

MODE FOR INVENTION

Hereinafter, the present invention will be described in detail with reference to the accompanying drawings. Here, repeated descriptions and detailed descriptions of publicly-known functions and configurations will be omitted so as to avoid unnecessarily obscuring the subject matter of the present invention. Exemplary embodiments of the present invention are provided to completely explain the present invention to a person with ordinary skill in the art. Therefore, shapes and sizes of elements illustrated in the drawings may be exaggerated for a more apparent description.

Throughout the specification, unless explicitly described to the contrary, the word "comprise" or "include" and variations, such as "comprises", "comprising", "includes" or "including", means the further inclusion of stated constituent elements, not the exclusion of any other constituent elements.

Hereinafter, exemplary embodiments are proposed to help understand the present invention. However, the following exemplary embodiments are provided just for more easily understanding the present invention, and the contents of the present invention are not limited by the exemplary embodiments.

<Film Wrinkle Removing Roller>

FIG. 1 is a view schematically illustrating a structure of a film wrinkle removing roller 100 according to an exemplary embodiment of the present invention, and FIG. 2 is a view schematically illustrating a state in which a film comes into contact with the film wrinkle removing roller 100 according to the exemplary embodiment of the present invention.

Referring to FIG. 1, the film wrinkle removing roller 100 according to the exemplary embodiment of the present invention may include a cylindrical roll 10, a pair of pattern rolls 20 having patterns, and a roll fixing unit 30 configured to fix positions of the roll 10 and the pattern rolls 20. (a) of FIG. 1 shows the film wrinkle removing roller 100 with the pair of pattern rolls 20 abutting the roll 10, and (b) of FIG. 1 shows the film wrinkle removing roller 100 with the pair of pattern rolls 20 separated from the roll 10.

First, the roll 10 has a cylindrical shape, and an entire surface of the roll 10 may be plain without patterns.

The roll 10 may be made of metal such as aluminum, copper, or zinc and the entire surface of the roll 10 made of metal may be coated with Teflon (PTFE), or the entire roll 10 may be made of Teflon.

For example, the cylindrical roll 10 is made of aluminum, the entire surface of the aluminum roll 10 is coated with Teflon with a predetermined thickness, and then the Teflon is hardened at a hardening temperature, such that surface frictional force of the roll 10 may be minimized.

In particular, the cylindrical roll 10 may come into contact with a porous film (not illustrated). In this case, the porous film may be used for a separation membrane for a rechargeable battery and a reinforcement membrane of a fuel cell. As the porous film, polyethylene (PE), polypropylene (PP), polytetrafluoroethylene (PTFE), and polyethylene terephthalate (PET) may be applied.

When the roll 10 made of Teflon and the porous film come into contact with each other, the frictional force between the porous film and the roll 10 is minimized, such that a raw porous film may easily move, and thus productivity of the porous film may be improved.

In this case, a length of the roll 10 may be equal to a width (length) of an effective area of the porous film to be in contact with the roll 10, such that damage to the effective area of the surface of the porous film may be prevented and the film may be prevented from being torn.

In addition, the roll 10 is coated with Teflon with a diameter equal to a diameter of the effective area of the porous film, such that a pore structure of the surface of the porous film may be prevented from being deformed when the porous film passes the roll 10.

Next, the pair of pattern rolls 20 may be positioned at both ends of the cylindrical roll 10, and may include first and second pattern rolls 20*a* and 20*b* disposed at the both ends of the roll 10, respectively.

Here, the cylindrical roll 10 and the pair of pattern rolls 20 may be separated from one another and may be made of materials having different frictional forces.

The pattern roll 20 may be made of metal such as aluminum, copper, or zinc, and the entire surface of the pattern roll 20 made of metal may be coated with rubber with a predetermined thickness.

The rubber may be styrene-butadiene rubber (SBR), butadiene rubber (BR), chloroprene rubber (CR), nitrile rubber (NBR), ethylene-propylene rubber (EPDM), chlorosulfonated polyethylene rubber (CSM), acrylic rubber (ACM), fluororubber (FPM), or the like.

For example, the first and second pattern rolls 20*a* and 20*b* each having a cylindrical shape may be made of aluminum, the entire surface of each of the first and second pattern rolls 20*a* and 20*b* may be coated with styrene-butadiene rubber with a predetermined thickness, and then pattern processing may be performed to form various patterns on the pattern rolls 20.

The first and second pattern rolls 20*a* and 20*b* formed with the patterns are hardened at a hardening temperature of the rubber and then may be assembled to both ends of the roll 10.

Here, the hardening temperature of the pattern rolls 20 and the hardening temperature of the roll 10 are different from each other, and as a result, the roll 10 and the pattern rolls 20 are processed at the different hardening temperatures and then may be assembled and integrated.

The patterns of the first and second pattern rolls 20*a* and 20*b* may be formed to be symmetrical to one another, and the first and second pattern rolls 20*a* and 20*b* may have various patterns such as V-shaped patterns (chevrons), herringbone patterns, diamond patterns, horizontal patterns, vertical patterns, or diagonal patterns.

For example, in the case in which the pattern rolls 20 have diagonal patterns, diagonal grooves and diagonal protrusions may be symmetrically formed on the first and second pattern rolls 20*a* and 20*b*, and the diagonal protrusions of the first and second pattern rolls 20*a* and 20*b* may be made of rubber to improve surface frictional force.

Referring to FIG. 2, the first and second pattern rolls 20*a* and 20*b* formed with the patterns may be disposed at and assembled to both ends of the cylindrical roll 10, and the surfaces of the roll 10 and the first and second pattern rolls 20*a* and 20*b*, which are integrated, may come into contact with the porous film.

In more detail, the diameter of the roll 10 made of Teflon may be equal to the diameter of the effective area of the porous film, the first and second pattern rolls 20*a* and 20*b* made of rubber may be assembled to and integrated with both ends of the roll 10, and the porous film may come into contact with the roll 10 and the pattern rolls 20 which are integrated.

In this case, a portion of the porous film, which comes into contact with the roll 10 made of Teflon, is the effective area of the film where the abrasion of the film is prevented. Portions of the porous film, which come into contact with the first and second pattern rolls 20*a* and 20*b*, are both edges of the film except for the effective area and may be cut out by a rear end edge trimming (slitting) process.

In addition, the patterns of the first and second pattern rolls 20*a* and 20*b* are made of rubber, such that frictional force may be applied between the pattern rolls 20 and the porous film. Therefore, the first and second pattern rolls 20*a* and 20*b* pull the porous film in the width direction of the film, such that wrinkles formed in the movement direction of the film may be removed.

Since the cylindrical roll 10 made of Teflon is provided between the pair of pattern rolls 20 made of rubber and the thin porous film comes into contact with the roll 10 and the pattern rolls 20, it is possible to prevent an abrasion that causes an afterimage of the pattern to be formed on the surface of the porous film, it is possible to prevent an abrasion of a pore structure of the surface of the film, and as a result, it is possible to uniformly coat the surface of the film during the film coating.

In particular, the process of removing the wrinkle of the film and the process of preventing damage to the film are simultaneously performed while the porous film comes into contact with the roll 10 and the pattern rolls 20, such that it is possible to shorten the time taken to move the porous film, and it is possible to improve efficiency in producing the porous film.

Next, the roll fixing unit 30 may be inserted into the assembly of the roll 10 and the pattern rolls 20. In this case, the roll fixing unit 30 may be made of metal such as aluminum, copper, or zinc.

A length of the roll fixing unit 30 may vary depending on the diameters of the roll 10 and the pattern rolls 20. The length of the roll fixing unit 30 may also be increased as the diameters of the roll 10 and the pattern rolls 20 are increased.

As described above, since the roll fixing unit 30 is inserted into the roll 10 and the pattern rolls 20 to fix the positions of the roll 10 and the pattern rolls 20, it is possible to prevent the roll 10 and the pattern rolls 20 from being separated from one another during the process of moving the porous film.

Example

A roll was manufactured by coating a cylindrical body made of aluminum with Teflon (PTFE). In addition, pattern rolls were manufactured by coating a pair of cylindrical bodies made of aluminum with styrene-butadiene rubber (SBR) and then forming diagonal patterns thereon. Here, the diagonal patterns of the pair of pattern rolls were formed to be symmetrical to one another. The pair of pattern rolls was disposed at both ends of the manufactured roll, the roll fixing unit was inserted into the roll and the pattern rolls, and then the roll and the pattern rolls were assembled and integrated, such that a film wrinkle removing roller was manufactured.

Comparative Example

An entire cylindrical body was made of styrene-butadiene rubber (SBR), and then V-shaped patterns were formed on the entire surface of the body, such that a film wrinkle improving roller was manufactured by using only the pattern rolls. Here, the V-shaped patterns of the pattern rolls were provided in the form of diagonal patterns symmetrical to one another.

Experimental Example

Measurement of change in porous film in contact with film wrinkle removing roller The porous films were brought into contact with the film wrinkle improving roller of Comparative Example and the film wrinkle removing roller of Example. In this case, the porous films in contact with the film wrinkle improving roller of Comparative Example and the film wrinkle removing roller of Example have the same material, the same shape, and the same size, and the porous films made of polypropylene (PP) were provided.

In this case, the Comparative Example and the Example operate at the same temperature, and the magnitude of the movement tension of the porous film remains the same in the Comparative Example and the Example.

(a) of FIG. 3 is a view schematically illustrating a shape of the film wrinkle removing roller according to a Comparative Example and (b) of FIG. 3 is a view schematically illustrating a shape of a film wrinkle improving roller according to the present invention.

FIG. 4 is a view illustrating a comparison between the film that has passed the film wrinkle removing roller according to the Example of the present invention and the film that has passed the film wrinkle improving roller according to the Comparative Example.

Referring to FIG. 4, (a) of FIG. 4 illustrates a photograph of the surface of the porous film and an SEM photograph of pores in the surface of the film that has been in contact with the film wrinkle improving roller of Comparative Example, and (b) of FIG. 4 illustrates a photograph of the surface of the porous film and an SEM photograph of pores in the surface of the film that has been in contact with the film wrinkle removing roller of Example of the present invention.

Afterimages identical to the V-shaped patterns of the pattern rolls made of rubber were formed on the surface of the porous film that had been in contact with the film wrinkle improving roller of Comparative Example, and an abrasion occurred on the surface of the film. For this reason, the pores were clogged as the pore structure of the surface of the film was deformed.

In contrast, afterimages of the diagonal patterns of the pattern rolls made of rubber were rarely formed on the surface of the porous film that had been in contact with the film wrinkle removing roller of Example, and the pore structure of the surface of the porous film was maintained as it is without being deformed.

That is, it can be seen that in comparison with the surface of the porous film that has been in contact with the film wrinkle improving roller of Comparative Example, less damage occurs on the surface of the porous film and an abrasion of the surface of the film is prevented, such that the deformation of the pores in the surface of the film is prevented, in the case of the porous film that has been in contact with the film wrinkle removing roller of Example.

While the present invention has been described above with reference to the exemplary embodiments, it may be understood by those skilled in the art that the present invention may be variously modified and changed without departing from the spirit and scope of the present invention disclosed in the claims.

The invention claimed is:

1. A film wrinkle removing roller, comprising:

a roll having a cylindrical shape;

a pair of pattern rolls positioned at both ends of the roll and having patterns; and a roll fixing unit configured to fix positions of the roll and the pattern rolls, wherein the pair of pattern rolls are separable from the roll, and wherein the pair of pattern rolls are made of a different material having a different frictional force than a material and a frictional force of the roll.

2. The film wrinkle removing roller of claim 1, wherein the roll is made of metal and an entire surface of the roll is coated with Teflon having a predetermined thickness.

3. The film wrinkle removing roller of claim 1, wherein the roll is made of Teflon.

4. The film wrinkle removing roller of claim 1, wherein each pattern roll is made of metal and an entire surface of each pattern roll is coated with rubber having a predetermined thickness.

5. The film wrinkle removing roller of claim 1, wherein the pair of pattern rolls includes a first pattern roll disposed at a first end of the roll and a second pattern roll disposed at a second end of the roll, the first end of the roll being opposite to the second end of the roll.

6. The film wrinkle removing roller of claim 5, wherein the pattern of the first pattern roll is symmetrical to the pattern of the second pattern roll.

* * * * *